United States Patent [19]

Wuebker

[11] 4,324,596

[45] Apr. 13, 1982

[54] METHOD FOR SUBSTANTIALLY COLD WORKING NONHEAT-TREATABLE ALUMINUM ALLOYS

[75] Inventor: Robert A. Wuebker, Westerville, Ohio

[73] Assignee: General Signal Corporation, Stamford, Conn.

[21] Appl. No.: 201,782

[22] Filed: Oct. 29, 1980

[51] Int. Cl.[3] ..... C22F 1/04

[52] U.S. Cl. ..... 148/11.5 A

[58] Field of Search ..... 148/11.5 A, 12.7 A

[56] References Cited

U.S. PATENT DOCUMENTS

| | | |
|---|---|---|
| 2,137,624 | 1/1936 | Nock, Jr. et al. . |
| 3,078,191 | 2/1963 | Maeda . |
| 3,952,571 | 4/1976 | Yokota et al. . |
| 3,960,607 | 6/1976 | Manzonelli et al. . |

FOREIGN PATENT DOCUMENTS

| | | |
|---|---|---|
| 2810188 | 9/1979 | Fed. Rep. of Germany . |
| 39-8652 | 5/1964 | Japan . |
| 49-43047 | 11/1974 | Japan . |

OTHER PUBLICATIONS

"Forming Alcoa Aluminum," Aluminum Company of America, pp. 5–47; 217–230.

*Primary Examiner*—W. Stallard

*Attorney, Agent, or Firm*—Leitner, Palan, Martin & Bernstein

[57] ABSTRACT

A strain hardened, nonheat-treatable aluminum-magnesium alloy bar is cold worked. A selected segment of the cold worked portion is selectively heated to regain ductility of this segment. The selected segment is then cold worked to the final shape. The resulting product is a strain hardened structural element.

16 Claims, 7 Drawing Figures

FIG. 1
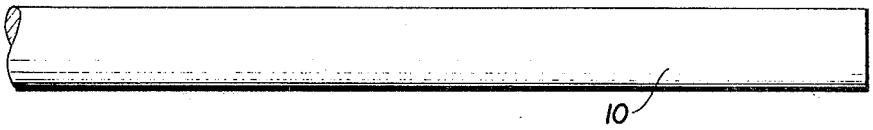
FIG. 2
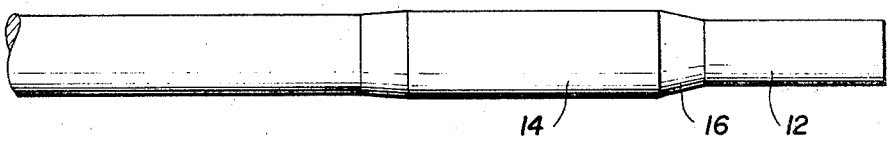
FIG. 3
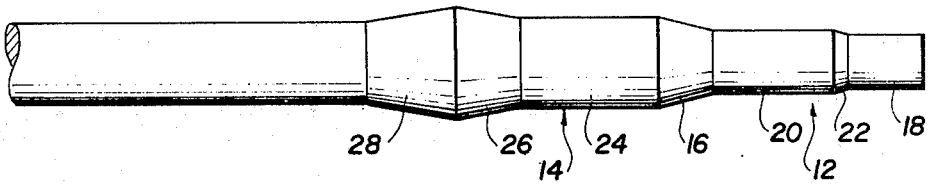
FIG. 4
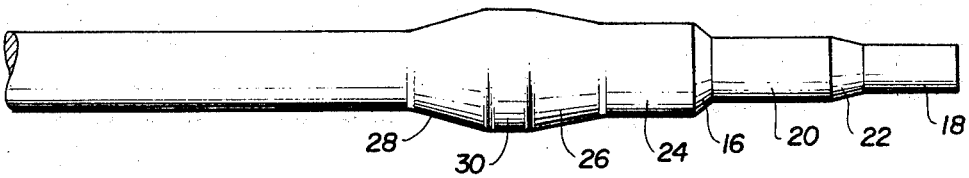
FIG. 5
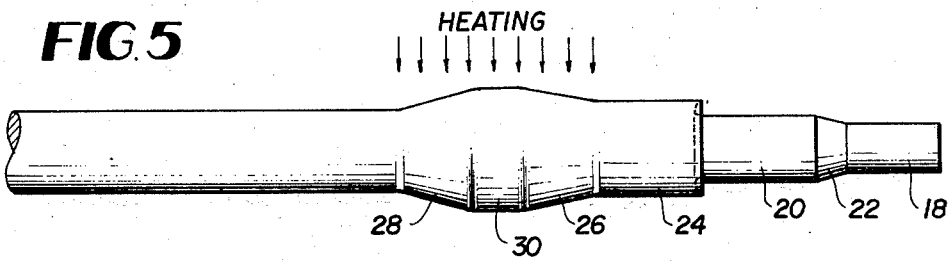
FIG. 6
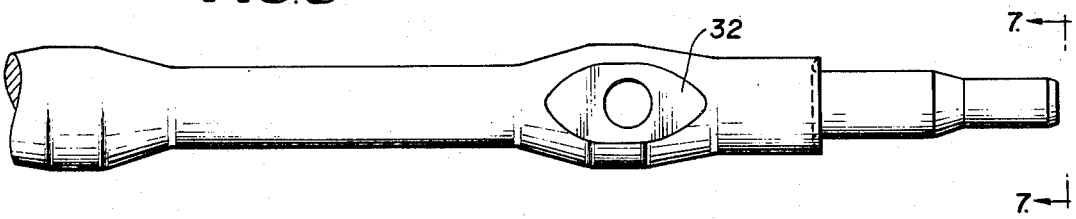
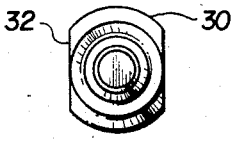
FIG. 7

METHOD FOR SUBSTANTIALLY COLD WORKING NONHEAT-TREATABLE ALUMINUM ALLOYS

BACKGROUND OF THE INVENTION

This invention relates generally to forming elements from aluminum alloys and more particularly to cold working nonheat-treatable aluminum alloys.

Aluminum alloys may be classified in two groups, namely nonheat-treatable and heat-treatable alloys. Nonheat-treatable alloys are hardened by a combination of alloying and strain hardening. Heat-treatable alloys are strengthened by a combination of alloying and heat treating. The strength of the nonheat-treatable materials is produced by the specific working. As the material is worked it hardens and has reduced ductility. In the heat-treatable materials, the material is worked with no or minimal increase in strength until a final heat treating process known as aging. The final product is taken to temperature for an extended period of time and then quenched. Since the heat-treatable materials remain more ductile they are generally used for products which require substantial amounts of deformation during forming. This allows the material to be worked through successive operations without intermediate thermal processing. The final physical properties are achieved through heat treatment. Thus, they are not considered applicable to the process used to form structural elements and obtain the physical strength without a heat treatment.

With the increased cost of fuel, there is a great interest in the auto industry to reduce the weight of different vehicles. Designers have been turning to the expensive, but light-weight, high strength aluminum materials to duplicate structural elements of an automobile. Heretofore, the only method of forming these structural elements was by machining casting or hot forging versus cold forming. The cold forming industry has a substantial amount of technology relative to steel but not to aluminum. The first attempt of industry to produce structural elements for use in automobiles was directed to heat-treatable alloys. Because of their strength, formability and resistance to corrosion, heat-treatable aluminum alloys were initially investigated. The lower heat tempered alloys did not have sufficient column strength to be upset and formed into the required elements and the higher tempered alloys were not ductile enough to be cold worked including upsetting followed by other subsequent cold working processes. Also to achieve the desired strength of the end-product, the total element had to be heat-treated which required excessive energy and time.

Thus there exists a need for a selection of an appropriate aluminum alloy and a process for cold working such alloy to produce an aluminum element capable of withstanding the loads for use as structural elements in automobiles.

SUMMARY OF THE INVENTION

An object of the present invention is to provide an aluminum alloy which can be cold worked to the desired strength.

Another object of the present invention is to provide a method for cold working a nonheat-treatable aluminum alloy to form structural elements for use in automobiles.

Still another object of the present invention is to select an aluminum alloy capable of being cold worked to the desired strength using similar process steps as those used for steel.

These and other objects of the invention are attained by selecting an aluminum alloy which includes at least 1% magnesium, is strain-hardened or H-tempered, is nonheat-treatable and has a yield strength of approximately 50,000 psi. The aluminum alloy bar is cold worked during a first process, a segment of the cold worked portion can be selectively annealed to regain the ductility of that segment of the bar and subsequent cold working steps can be performed on the annealed segment. The stress hardened temper is HX2 where X may be 1, 2 or 3. The first cold working process can include a plurality of blows and may be used to form a reduced diameter section and an upset section. The upset section which may be displaced from the end of the bar is the one that is selectively heated and further cold worked by, for example, coining. The heating step merely brings the section up to a specified temperature, and it is not held at that temperature. It is allowed to immediately cool.

Other objects, advantages and novel features of the present invention will become apparent from the following detailed description of the invention when considered in conjunction with the accompanying drawings.

BRIEF DESCRIPTION OF THE DRAWINGS

FIGS. 1–6 illustrate the process incorporating the principles of the present invention to form an upper control arm shaft of an automobile suspension.

FIG. 7 is a side view of the element of FIG. 6.

DESCRIPTION OF THE PREFERRED EMBODIMENTS

Through trial and error, it has been discovered that the 5000 series of aluminum alloys are those which are capable of work hardening to the desired strength while having sufficient column strength to cold work using the process steps for steel cold working. The 5000 series is an aluminum alloy containing various percentages of magnesium varying from approximately 1% to 6%. The difference in the various alloys in the 5000 series represents the amount of other impurities, for example, magnesium and chromium. The properties of the material are described in U.S. Pat. No. 2,137,624. For experiments to date, the most useful 5000 series aluminum alloy is the 5083 and the 5086 alloy. The 5083 contains 4.45% magnesium, 0.6% manganese and 0.15% chromium. The 5086 alloy contains 4% magnesium, 0.45% manganese and 0.15% chromium. The 5083 and 5086 have generally been used in the form of plate for maximum strength in welded assemblies. They have been used to form pressure vessels, truck tanks, ships, dump truck bodies, super structures, armor plate and cryogenic vessels. Because of their response to work or strain hardening, it has been suggested that the 5000 series be worked at elevated temperatures in the range of 400°–450° F.

For the type of cold working to be performed to create a structural element especially designed for an automobile, the aluminum alloy bar must have a sufficient column strength. It has been found through experimentation that a strain hardened or H-tempered aluminum-magnesium alloy should be used. The bar should have a yield strength of approximately 50,000 psi within a plus or minus 5,000 psi range. For the 5000 series aluminum-magnesium alloy, the bar should have a temper of H12, H22 or H32. The second digit from the letter indicates that the bar has been pre-processed to be a quarter hard by strain hardening processes. The bar is thus capable of substantial cold working wherein each blow strain hardens the cold worked area to the final strength and still has sufficient ductility to form.

Heretofore, major reshaping by cold heating or upsetting has generally been restricted to the use of heat-treatable aluminum alloys. It has generally been used to form fasteners, rivets and other types of small elements wherein the end is completely upset or disformed. The only 5000 series alloys suggested is a 5056 and 5052 for use as aircraft rivets.

The present process, by the selection of appropriate work hardening nonheat-treatable alloy, can use similar work sequences as used for steel to produce load bearing elements. These require substantial cold working resulting in an upset portion displaced from the end of the bar or stock which can require further cold working. Before the present invention, such massive cold working was not considered feasible. To illustrate the process of the present invention, a sequence of forming will be shown for an upper control arm shaft of an automobile. This is illustrated in FIGS. 1–7. A bar or blank 10 is illustrated in FIG. 1 and may have a diameter of, for example, 0.820 inches. The bar 10 is inserted into a cold working or heading machine and a first blow forms a reduced diameter portion 12 at the end thereof and is connected to an increased diameter section 14 by a varying diameter section 16. After the second blow, as illustrated in FIG. 3, the reduced diameter in section 12 is further reduced to form end sections 18 and 20 connected by a varying diameter section 22. The increased diameter section 14 further increases to have a substantially uniform increased diameter section 24 and a pair of varying diameter sections 26 and 28. The varying diameter section 26 is external the die whereas the other varying diameter section 28 is internal the die.

In response to the third blow, as illustrated in FIG. 4, reduced diameter section 18 is further reduced and elongated, section 20 is shortened and the diameter is slightly increased, and section 22 is further elongated. Sections 16 and 24 are shortened with an appropriate increased diameter. The varying diameters of sections 26 and 28 reach a limited increase of diameter as fixed by the die and have a common or connecting flat maximum diameter section 30 therebetween. In response to the fourth blow, the final structure, as illustrated in FIG. 5, is produced. Section 18 has a further reduction in diameter and elongation. Sections 20 and 24 are further contracted with accompanying increased diameter. The resulting structure has various cold work portions including reduced diameter sections 20, 22 and 18 and the upset section includes portions 24, 26, 28 and 30.

The flat portion 30 has a final diameter of 1.25 inches, the increased portion 24 has a final diameter of 0.970 inches, the portion 20 has a diameter of 0.666 inches, and portion 18 has a diameter of 0.2494 inches. Thus, it can be seen that the column strength must be fairly high for the upset portion to increase the diameter 50% of the original diameter.

The yield strength of the cold worked portions have increased from the original stock material of 50,000 psi to approximately 60,000 psi.

Since additional steps are needed to form the final product, those portions which are to be further cold worked must regain their ductility in order to be cold worked. Without such increased ductility, the part cannot be further worked without structural damage. Thus, as illustrated in FIG. 5 by the arrows, the upset sections 26, 28 and 30 are selectively subjected to heat to regain sufficient ductility to allow further cold working without substantially reudcing the previously cold worked properties. This may be done by induction heating. For the 5083 and 5086 alloy of the present example, the upset sections are heated in the range of 650° to 700° F. This is below what is considered a normal annealing temperature which is 850°–900° F. The selected section is subjected to instantaneous heating. It is brought up to the required temperature and then allowed to cool. No holding period follows reaching the required temperature. The heated section with the increased ductility is then further cold worked by, for example, coining to produce the flat surface 32 as illustrated in FIGS. 6 and 7. The final cold working step work hardens the previously heated section and thus the total cold worked areas have a substantially uniform yield strength.

It should be noted that the upset or increased diameter sections 26, 28 and 30 which are subsequently heat-treated are displaced from the end of the original bar 10. This is distinct from prior art processes wherein the head of the fastener is the upset portion and it is on the end of the bar. The prior upsetting of aluminum used highly ductile alloys since they do not need the column strength. The restriction on the deformation was provided by the die versus the column strength of the material.

Although the present invention has been illustrated for a specific element, namely the upper control arm shaft, it may be used for other sequences of cold working processes wherein selective heating may be required of the cold worked portion of the first step in a sequence where additional cold working steps are needed. The first cold working step could include, for example, drawing to a finished size to increase the physical properties and cut the bar length. This can be done on a standard machine using a solid draw die of a proper configuration. This should not reduce the ductility of the product sufficient to require an intermediate heating step. If it does, the total bar may be heated.

This may be followed by cold extrusions wherein the ends of the bar are reduced. This is done on a heading machine wherein a portion of the material is left free of contact with the tools. In addition to cold extrusion, the first cold working may also include cold upsetting wherein an increase in the area or shape to a larger size or configuration results. This is done on a heading machine wherein a portion of the material is left free of contact with the tools. This can be done either in an open die or in a solid machine.

As previously mentioned, selected areas that require further deformation to achieve the final shape are selectively heated. This retains most of the physical qualities previously added to the work-hardened material. This is followed by the cold working of the selectively heated areas. This may include cold coining as in the previous example or may include bending separately or in combination with cold coining. These subsequent steps are performed in an open die versus a closed die forging.

The present process allows the grain boundaries to conform to the deformed configuration of the article. By minimizing the heating process, the increased characteristics produced by the shaped grain boundaries are not removed by heat treating. The present process allows the formation from aluminum of elements previously restricted only to steel. Similarly, it allows the formation of products previously limited to heat-treatable aluminum.

Another example of a product which may be formed using the present process is the wire suspension arm illustrated in U.S. Pat. No. 4,170,373. Prior to discovery of the present process, such an element could not be formed from aluminum and was restricted to steel processing. The present process allows the substantial upsetting or deformation of the elements. This will allow the upsetting into a ball and followed by coining of the end portions of the suspension arm illustrated in the aforementioned patent.

From the preceding description of the preferred embodiments, it is evident that the objects are attained in that a process is provided using a specially selected aluminum alloy to produce structural elements using cold working processes restricted previously to steel. Although the invention has been described and illustrated in detail, it is clearly understood the same is by way of illustration and example only and is not to be taken by way of limitation. The spirit and scope of the present invention are to be limited only by the terms of the appended claims.

What is claimed:

1. A method of forming an article of an aluminum alloy by cold working comprising:

selecting a strain-hardened, H-tempered, nonheat-treatable aluminum alloy bar;

cold working an end of said bar to create a first and second reshaped portion;

selectively heating said second reshaped portion to regain ductility; and selectively cold working said second reshaped portion.

2. The method of claim 1 wherein said aluminum alloy is selected to have a yield strength of approximately 50,000 psi.

3. The method of claim 1 wherein said aluminum alloy is selected to be tempered HX2 wherein X is 1, 2 or 3.

4. The method of claim 1 wherein said aluminum alloy is an aluminum-magnesium alloy having more than 1% magnesium.

5. The method of claim 4 wherein said alloy includes manganese.

6. The method of claim 5 wherein said alloy includes chromium.

7. The method of claim 1 wherein said first cold working step includes multiple blows to form a reduced portion and an upset portion; said upset portion is said second portion.

8. The method of claim 7 wherein said upset portion is displaced from the worked end.

9. The method of claim 1 wherein said first cold working step forms an upset portion having a thickness at least 25% greater than the thickness of the original bar.

10. The method of claim 1 wherein said second cold working step is performed in an open die machine.

11. The method of claim 1 wherein said heating step includes bringing said second portion to a desired temperature and immediately allowing it to cool.

12. A method of forming a structural element of an aluminum alloy comprising:

selecting a strain-hardened, H-tempered, nonheat-treatable aluminum alloy bar having a yield strength of approximately 50,000 psi;

cold working said alloy;

selectively heating a segment of the cold worked portion of said bar to regain ductility; and cold working said segment to a final shape and strength.

13. The method of claim 12 wherein said aluminum alloy is selected to be tempered HX2 wherein X is 1, 2 or 3.

14. The method of claim 12 wherein said aluminum alloy is an aluminum-magnesium alloy having more than 1% magnesium.

15. The method of claim 12 wherein said segment is heat treated below the solution temperature of the alloy.

16. The method of claim 12 wherein said heating step includes bringing said segment to a desired temperature and immediately allowing it to cool.

* * * * *